United States Patent [19]

Esna-Ashari

[11] 4,248,628

[45] Feb. 3, 1981

[54] METHOD FOR LEACHING AND PRECIPITATING METAL VALUES FROM SOLIDS

[75] Inventor: Mohammed Esna-Ashari, Bergisch-Gladbach, Fed. Rep. of Germany

[73] Assignee: Klöckner-Humboldt-Deutz AG, Fed. Rep. of Germany

[21] Appl. No.: 53,310

[22] Filed: Jun. 29, 1979

[30] Foreign Application Priority Data

Jul. 1, 1978 [DE] Fed. Rep. of Germany ..... 2829060

[51] Int. Cl.[3] ..... C22B 1/00

[52] U.S. Cl. ..... 75/101 R; 75/109; 75/117; 423/27

[58] Field of Search ..... 75/101 R, 109, 117; 423/27

[56] References Cited

U.S. PATENT DOCUMENTS

| | | | |
|---|---|---|---|
| 1,268,940 | 6/1918 | Dosenbach | 75/109 X |
| 2,083,031 | 6/1937 | Maclennan | 75/109 |
| 2,716,600 | 8/1955 | Frick et al. | 75/109 X |
| 3,457,035 | 7/1969 | Barker | 423/604 |
| 3,701,651 | 10/1972 | Hack et al. | 75/101 R |
| 3,993,293 | 11/1976 | Mukae et al. | 75/101 R |
| 4,119,699 | 10/1978 | Kellerwessel et al. | 75/101 R |
| 4,152,143 | 5/1979 | Kausel | 74/109 |

*Primary Examiner*—G. Ozaki

*Attorney, Agent, or Firm*—Hill, Van Santen, Steadman, Chiara & Simpson

[57] ABSTRACT

Method and apparatus for leaching and precipitating metal values from a metal bearing solid in which the solid is simultaneously crushed and acid leached in a vibratory grinding mill, and the pulp thus produced is subjected to a simultaneous leaching and precipitation step in a vibratory reactor into which there is introduced a metal which is higher in the electromotive series than the metal to be recovered, together with controlled amounts of water.

9 Claims, 1 Drawing Figure

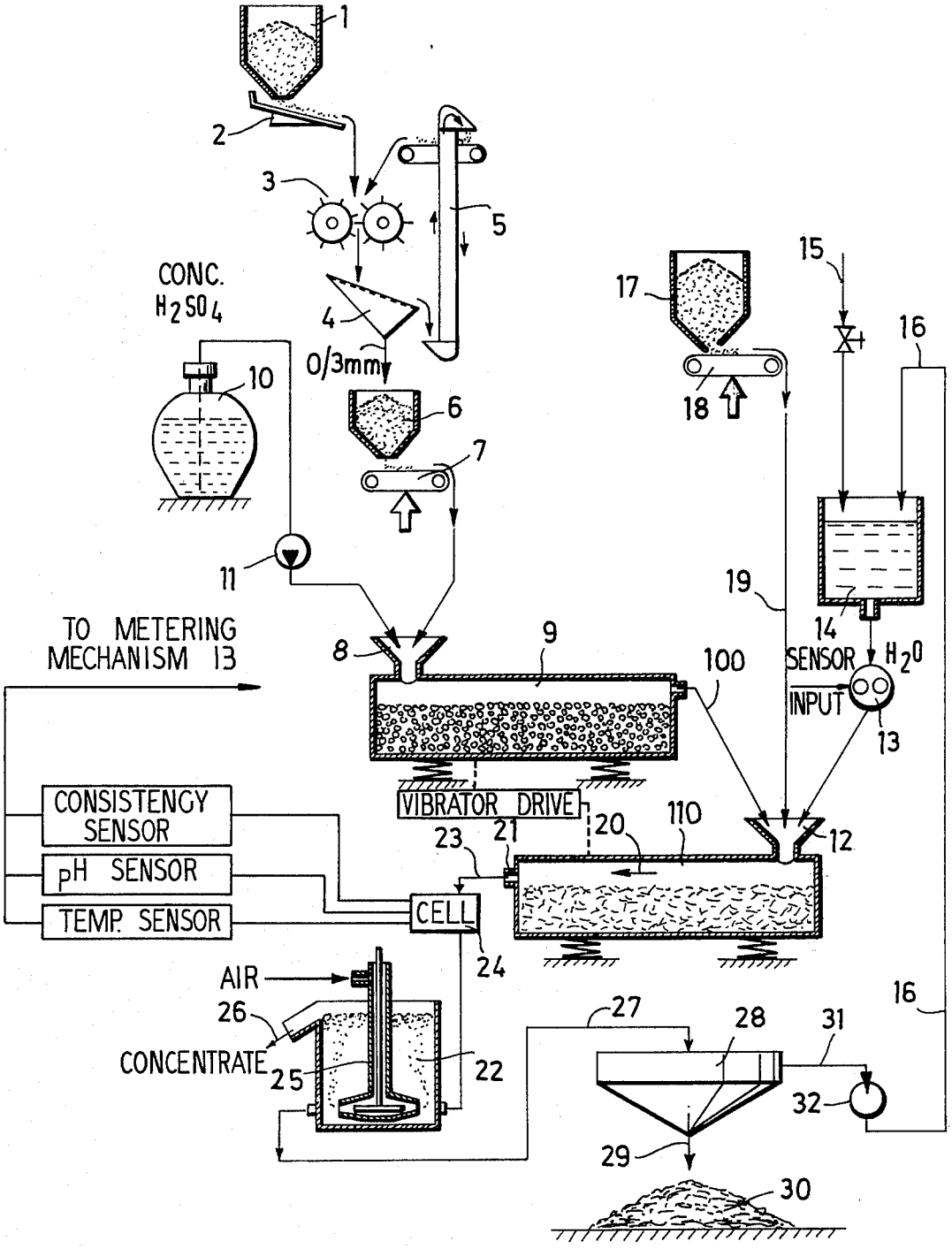
1
2
3
5
CONC.
$H_2SO_4$
4
0/3mm
10
6
7
11
17
15
16
18
19
14
SENSOR
$H_2O$
INPUT
13
TO METERING
MECHANISM 13
8
9
100
VIBRATOR DRIVE
110
12
CONSISTENCY
SENSOR
pH SENSOR
TEMP. SENSOR
23
21
20
CELL
24
AIR
26
CONCENTRATE
25
22
27
28
31
32
29
30
16

METHOD FOR LEACHING AND PRECIPITATING METAL VALUES FROM SOLIDS

BACKGROUND OF THE INVENTION

1. Field of the Invention

This invention is in the field of leaching or lixivating metal from metal bearing solid matter involving treatment first in a vibratory grinding mill and then in a vibratory reactor where the precipitation of metal values takes place.

2. Description of the Prior Art

There is a method for leaching and precipitating metal from metal bearing solid matter described in German AS 26 02 849 in which the leaching process as well as a precipitation is carried out simultaneously in a vibrating reaction vessel. From this known method, it might be advisable to carry out the leaching and precipitation simultaneously with the mechanical crushing of the metal bearing solid matter.

Attempts to simultaneously leach and precipitate copper ores of different origin with diluted sulfuric acid in a vibratory reactor have shown that the dissolution of the sufuric acid soluble components of the charged material proceeds significantly slower than the cementation of the copper ions disposed in the solution, and thus determines the speed with which the combined method can be carried out. In order to achieve a satisfactory yield in the case of this method, reaction times on the average of about 300 seconds or so had to be used whereas only about 60 seconds were required for the cementation. This long reaction time for leaching, in relation to cementation, would lead to an unrealistically large number of oscillating reactors being necessary for the use of such a system in a medium size plant.

In order to shorten the leaching time in the vibrating reactor and thereby reduce the number of vibrating reactors required, the simultaneous leaching and precipitation could be carried out such that a preleaching of conventional type would be effected outside the vibrating reactor, for example, in a stirring receptacle. Subsequently, the pulp thus produced could be subjected to a treatment in the vibrating reactor whereby the pulverization, post-leaching and cementation simultaneously take place in the vibrating reactor. In this modified method of operation, there is the disadvantage that because of the brief dwell time of direct contact in the vibrating reactor, there is an unsatisfactory grinding resulting in unfavorable precipitation, thereby reducing the yield of the desired metal.

Experimental results with this modified method of operation did, indeed, lead to the finding that the leaching time in the vibrating reactor could be shortened to 120 seconds, with a preceding stirring or agitation leaching of approximately 3600 seconds in order to achieve a similar yield of the sulfuric acid soluble component as was possible in the vibration grinding mill without preleaching. Accordingly, in this modified method, there resulted only an exchange of vibrating reactors for a corresponding number of stirring or agitating receptacles, without any improvement in result.

In the case of the known methods, diluted sulfuric acid attacks metallic reactor materials to a considerable extent. This causes a considerable wear or requires a lining of the reactor walls with a rubber or ceramic material. This is a substantial capital expenditure, and substantially increases the expense.

SUMMARY OF THE INVENTION

The present invention provides an optimum method for leaching and precipitating metals from metal bearing solid matter, and in particular provides a means for synchronizing the time sequence of the leaching process with the time sequence of the precipitation process so that they are integrated with each other in order to achieve a better overall operating cycle. The process is carried out with an increase in metal recovery over the other known processes. Because of a reduction in the rear of the reactor materials with the process of the invention, the investment in operating costs is reduced. In addition, the number of necessary vibrating reactors in relation to the weight rate of flow is reduced significantly.

In accordance with the present invention, at least the first stage of the crushing process which reduces the metal bearing material to leaching fineness, as well as the first stage of the leaching process, are carried out simultaneously in at lest one vibration grinding mill containing grinding members with the addition of concentrated acid, and the second stage of the leaching process is carried out simultaneously with the cementation process in a vibrating reactor in which cementation agents and water are added.

The process preferably makes use of a cementation agent in the form of lumps, consisting, for example, of scrap metal, granulated metal, punching scrap, and the like.

There are numerous advantages possessed by operating in accordance with the present invention which can be detailed as follows:

1. Concentrated sulfuric acid does not attack unalloyed iron materials, so that economical materials can be used without creating a corrosion problem in the reactor.

2. The utilization of concentrated acid in connection with mechanical crushing by the grinding members leads to an extremely intensive mechanical-chemical dissolution of the solid material as a result of which the dwell time in the vibratory grinding mill is significantly reduced.

3. It is accordingly possible for the material in the vibratory grinding mill to have a very high solids content thereby substantially increasing the throughput.

4. The dwell times for the crushing and leaching, as well as for the post-leaching and precipitation by cementation are accordingly harmoniously integrated with each other.

5. The number of reactors for a given system is reduced by at least one-half, thereby improving the economy of the method with regard to investment costs and operating costs.

6. The necessity of diluting the acid is eliminated.

7. The large amount of heat evolved as a consequence of the dilution of the concentrated acid accelerates the nonresidual dissolution of the solid matter as well as the cementation process.

8. The utilization of concentrated acid activates the leaching operation such that the metal yield is increased to an optimum value greater than 95%.

In a preferred embodiment of the method, the addition of concentrated acid into the vibratory grinding mill is regulated such that a concentration of solid matter results which is as high as possible with regard to the flowability of the pulp, whereas the addition of water in the vibrating reactor is regulated such that pulp concentration produced is suitable for the cementation process or for a subsequent treatment step.

The procedures are preferably carried out such that the solid concentration of the pulp is adjusted to the range of 500 to 1,500 g/l in the vibratory grinding mill, and to the range of 50 to 500 g/l in the vibratory reactor.

In one embodiment of the method, the addition of water to the vibrating reactor is regulated in accordance with the pulp concentration. In another form of the invention, the amount of water is determined by the temperature of the pulp resulting from the heat of dilution. In a further embodiment of the invention, the addition of water can be regulated in response to changes in the pH value of the pulp. Finally, it is also possible to add water depending upon the fluid flow characteristics of the pulp produced. Which of the measures is to be used depends upon the circumstances including the equipment available.

In a preferred form of the invention, the solid matter charged into the vibration grinding mill is crushed to a grain size of less than 10 mm, and preferably to no more than 3 mm.

A suitable apparatus for carrying out the method according to the present invention includes at least one vibratory grinding mill having at least one grinding tube, preferably horizontal, consisting of an unalloyed iron material without the necessity of a corrosion-proof protective lining, in combination with at least one vibrating reactor having a reaction space which is preferably tubular, is horizontally arranged, and is corrosion resistant by virtue of an acid-proof lining.

In the preferred embodiment of the invention, the vibratory grinding mill and the vibration reactor are connected to each other by means of a common vibration drive. It is particularly advantageous that the apparatus be so constructed that the vibratory grinding mill and/or the vibrating reactor are energized with high energy, whereby the oscillatory circuit diameter is on the order of 10 mm, and the frequency of oscillation is on the order of 15 Hz.

BRIEF DESCRIPTION OF THE DRAWINGS

The single figure of the drawings represents rather schematically a complete apparatus which can be used for the purposes of the present invention.

DESCRIPTION OF THE PREFERRED EMBODIMENTS

In FIG. 1 there is illustrated a supply receptacle 1 for the metal bearing solid matter in the form of particles. The solid matter is fed by means of a volumetrically dosaging device 2 to a crushing installation 3 which crushes the product, for example, to a grain size of 3 mm or less. Oversized particles are retained by a sifter 4 which delivers the same to an elevator 5 which recirculates the oversized particles back into the crushing system 3. The crushed, graded product is dumped into an intermediate receptacle 6 from which it is charged into a feed funnel 8 if a vibratory grinding mill 9 by means of a gravimetrically dosing conveyor type scale 7. Simultaneously, concentrated sulfuric acid is fed from a supply receptacle 10 by means of an acid pump 11 which operates in a dosing fashion to deliver the same to the feed funnel 8 of the vibratory grinding mill 9. Both reactants, the concentrated sulfuric acid and the metal bearing, precrushed and graded solid material are delivered to the vibratory grinding mill in a predetermined quantitative ratio by means of precise quantitative analysis, as a consequence of which the consistency of the pulp produced in the vibratory grinding mill 9 can be precisely adjusted. The addition of concentrated acid is adjusted such that a flowable thick pulp results. Such a thick pulp may contain, for example, between 500 and 1,500 g/l of solid matter.

In the vibratory grinding mill 9, there is an extensive grinding, mixing and activation of the introduced material resulting in a high mechano-chemical dissolution which takes place within a contact time of approximately 120 seconds. This is achieved by the extremely vigorous attack of the concentrated acid in combination with the grinding effect of the vibratory grinding mill which is filled typically up to 60 to 70% by volume with grinding members. Due to the peculiar property of the concentrated acid not attacking the iron material, the feed lines and the grinding tube as well as the grinding members can consist of unalloyed iron. This results in an additional economic advantage.

The product of the vibratory grinding mill is delivered by means of an outlet 100 directly into a vibrating reactor 110 through an intake funnel 12. In the vibrating reactor 110, water is added by means of a metering mechanism 13. The water is delivered from a water container 14 which contains fresh water delivered by means of a feed line 15 as well as circulating water from a line 16. A supply receptacle 17 is provided to deliver the precipitant, such as scrap iron in the case of copper precipitation, to the vibrating reactor 110 in a gravimetrically controlled quantity. The amount is weighed out by means of dosing conveyor type weigher 18 and is delivered to the vibrating reactor by means of a line 19.

The vibrating reactor 110 thus contains the thick pulp from the line 100 received from the vibratory grinding mill 9, diluted by the metered addition of water, together with a predetermined amount of precipitant 19 in the form of lumps. These reagents pass through the vibrating reactor 110 in a continuous mass flow whereby the solid portions in the pulp are acted upon by the lumpy precipitant and are leached out without residue from the acid, and simultaneously, through a metal ion exchange between the metal to be recovered and the precipitating metal which is higher in the electromotive series than the metal to be recovered, the metal is precipitated from solution as a product of the cementation reaction. Enough water is added into the vibrating reactor 110 so that the reaction medium has a pH value of 4 to 4.5 and the solid matter concentration is at a value in the range of 400 to 500 g/l. During dilution, the leaching solution becomes heated so that a leaching temperature of 50° to 60° C. results without additional heat being supplied. The solution flows continuously in the direction of the arrow 20 through the vibrating reactor 110, whereby cementation takes place very rapidly at the increased temperature.

By means of shaping of the cross sections, it is possible that the dwell time of the solution or of the pulp, respectively, in the vibrating reactor amounts to approximately 30 to 60 seconds. Subsequently, the pulp containing the cementation product and residual sulfide is transported out of the vibrating reactor through an overflow 21 and, for example, is directed to a flotation cell 22, such as is illustrated in purely schematic fashion in the drawing. The reaction mixture passing through an outlet line 23 passes through a measuring cell 24 which is measured by one or more of three different sensing means, namely, a consistency sensor, a pH sensor, or a temperature sensor.

In the flotation cell 22 there is a stirring mechanism or agitator 25 into which air is introduced through a suitable inlet line. The concentrate is drawn off by means of a discharge line 26 whereas the rejects are conveyed through a discharge line 27 to a thickener 28 to produce a sludge which is discharged by means of a line 29 to a refuse heap 30. The overflow containing substantial circulating water is delivered by means of a line 31 to a pump 32 which conveys the same through the line 16 back into the water receptacle 14.

A system described thus far represents one example of an embodiment of the invention. The example, of course, can be modified within wide boundaries depending upon various technical factors and the material being passed through the system. For example, the crushing can be carried out in the vibratory grinding mill to an extent that 100% of the crush material is smaller than 2 mm.

In addition, the apparatus can be such that the vibratory grinding mill and the vibration reactor are coupled by means of a common vibration system rigidly connecting the two together. In a known fashion, the vibration system can be designed such that one vibrating reactor is provided with two parallel-connected grinding tubes each, making it possible for the throughputs per unit time to be correlated with the reactor in a particularly advantageous manner.

It is also possible to modify the crushing system and the flotation installation by substituting systems such as a dehydration installation, a drying system with a pyrometallurgical production system, and the like.

All of these modifications come within the scope of the invention insofar as they come within one of the following claims.

I claim as my invention:

1. A method for leaching and precipitating metal values from a metal bearing solid which comprises:

simultaneously crushing said solid and treating with a concentrated acid in a single operation in a vibratory grinding mill to produce a high solids content pulp which still possesses suitable fluidity, passing the resulting pulp to a vibrtory reactor, further leaching said pulp in the presence of added water and reacting the same with a cementation medium capable of undergoing an ion exchange with the metal bearing solid to deposit the desired metal as a single operation in said vibratory reactor, and recovering the desired metal from the effluent of said vibratory reactor.

2. A method according to claim 1 in which said cementation medium is used in the form of lumps.

3. A method according to claim 1 in which said resulting pulp has a solids content of from 500 to 1500 grams per liter and the cenentation process is carried out with a solids concentration of 50 to 500 grams per liter.

4. A method according to claim 1 in which:

the effluent from said vibratory reactor is monitored for solids concentration, and the water added to said vibratory reactor is added in response to the solids content thus determined.

5. A method according to claim 1 in which:

the effluent from said vibratory reactor is monitored for temperature, and the water added to said vibratory reactor is added in response to the temperature thus determined.

6. A method according to claim 1 in which:

the effluent from said vibratory reactor is monitored for pH, and the water added to said vibratory reactor is added in response to the pH thus determined.

7. A method according to claim 1 in which:

the effluent from said vlbratory reactor is monitored for flow characteristics, and the water added to said vibratory reactor is added in response to the flow characteristics thus determined.

8. A method according to claim 1 in which the solid material is crushed in said vibratory grinding mill to a grain size of less than 10 mm.

9. A method according to claim 1 in which the solid material is crushed in said vibratory grinding mill to a grain size no more than 3 mm.

* * * * *